United States Patent [19]

Servé

[11] Patent Number: 5,024,330

[45] Date of Patent: Jun. 18, 1991

[54] PACKAGE FOR GROUPED ARTICLES

[75] Inventor: Philippe Servé, Overijse, Belgium

[73] Assignee: Societe Industrielle de Plastiques en abrege "Sipla", Brussels, Belgium

[21] Appl. No.: 518,331

[22] Filed: May 4, 1990

Related U.S. Application Data

[63] Continuation of Ser. No. 295,771, Jan. 11, 1989, abandoned.

[30] Foreign Application Priority Data

Jan. 20, 1988 [BE] Belgium ..... 08800076

[51] Int. Cl.[5] ..... B65D 73/00

[52] U.S. Cl. ..... 206/486; 206/443; 206/523; 206/602

[58] Field of Search ..... 206/486, 490, 523, 524, 206/562, 563, 443, 602

[56] References Cited

U.S. PATENT DOCUMENTS

| | | | |
|---|---|---|---|
| 2,492,081 | 12/1949 | Williams | 206/562 |
| 2,672,980 | 3/1954 | Halbach | 206/486 |
| 3,021,001 | 2/1962 | Donofrio | 206/602 |
| 3,346,939 | 10/1967 | Farquhar . | |
| 3,951,313 | 4/1976 | Conigilone | 206/601 |
| 4,037,722 | 7/1977 | Bremer | 206/523 |
| 4,159,597 | 7/1979 | Olsen | 206/563 |
| 4,233,799 | 11/1980 | Caille . | |
| 4,281,502 | 8/1981 | Bonkowski . | |
| 4,834,239 | 5/1989 | Osgood | 206/443 |

FOREIGN PATENT DOCUMENTS

| | | | |
|---|---|---|---|
| 1410347 | 6/1965 | France | 206/523 |
| 2310278 | 12/1976 | France . | |
| 2419880 | 10/1979 | France . | |
| 2427257 | 12/1979 | France . | |
| 1169894 | 7/1985 | U.S.S.R. | 206/523 |
| 1544983 | 4/1979 | United Kingdom . | |
| 2173174 | 10/1986 | United Kingdom | 206/523 |

*Primary Examiner*—David T. Fidei

*Attorney, Agent, or Firm*—Cushman, Darby & Cushman

[57] ABSTRACT

Package for grouped articles (5) presenting at least one extreme portion (4) having an outside cross-section which is lower than any analogous cross-section, essentially parallel to the first-named cross-section, of another portion (6) of these articles (5), in particular package for ampules, flasks, vials, syringes, bottles, comprising a support (1) in at least one of the faces (2) of which a number of recesses (3) are provided, in each of which said extreme portion (4) of said articles (5) can be maintained removably, the other portion (6) of the articles (5) being thus located outside the support (1), the distance (*d*) separating two adjacent recesses (3) being such that the articles (5) can extend side by side when their extreme portion (4) is at least partly entered into said recesses (3).

8 Claims, 5 Drawing Sheets

PACKAGE FOR GROUPED ARTICLES

This is a continuation of application Ser. No. 07/295,771, filed Jan. 11, 1989, which was abandoned upon the filing hereof.

BACKGROUND OF THE INVENTION

This invention relates to a package for grouped articles presenting at least on extreme portion having an outside cross-section which is lower than any analogous cross-section, essentially parallel to the first-named cross-section, of another portion of these articles, in particular package for ampules, flasks, vials, syringes, bottles.

The existing packages for ampules for example and for articles of a similar shape generally need either much man-power or investments for sophisticated and expensive automatical machines, or still a very high volume.

SUMMARY OF THE INVENTION

One of the essential objects of the present invention is to provide a type of package allowing to remedy said drawbacks and which moreover is of a very competitive cost price.

To this end, the package according to the invention comrises a support in at least one face of which a number of recesses are provided in each of which said extreme portion of said articles can be maintained removably, the other portion of the articles being thus located on the outside of the support, the distance between two adjacent recesses being such that the articles can extend side by side when their extreme portion is at least partly inserted in said recesses.

Advantageously, the recesses are located in the support at such a distance from each other that when the articles to be packaged are placed with their extreme postion in the recesses, said articles can bear against each other, forming with the support a substantially rigid assembly.

According to an advantageous embodiment of the invention, at least the support area which laterally delimits the recesses is made of a rather elastic material, which however has a sufficient rigidity to be able, on the one hand, to elastically grip the above-mentioned extreme portion of the articles to be packaged in the recesses and, on the other hand, to maintain these articles in position when they are arranged side by side with said extreme portion in the recesses.

According to a preferred embodiment, the support is made of a semi-rigid cellular material, such as polyethylene, polyurethane, polystyrene, rubber, in which holes forming the above-mentioned recesses are made.

The invention also concerns a process for carrying out said packaging.

This process is characterized in that the articles to be packaged are placed substantially in the same ordering as the distribution of recesses in the support with their above-mentioned extreme portion turned upwardly, and then said extreme portion turned upwardly and the support are brought closer until said extreme portions are at least parly entered into the corresponding recesses provided in the support.

The invention also concerns a plant for carrying out this process and which is characterized in that it comprises means for placing the articles to be packaged substantially according to the same ordering as the distribution of the recesses in a support with their above-mentioned extreme portion turned upwardly, and means to bring closer said extreme portion of said so arranged articles and a support until said extreme portions are at least partly entered into the corresponding recesses provided in this support.

Other details and particularities of the invention will become apparent from the description given hereafter by way of a non-limitative example, with reference to the enclosed drawings, of some particular embodiments of the package, the assembling process for this package and a plant for carrying out this process.

DETAILED DESCRIPTION OF THE PRESENTLY PREFERRED EXEMPLARY EMBODIMENT

Figure 1:
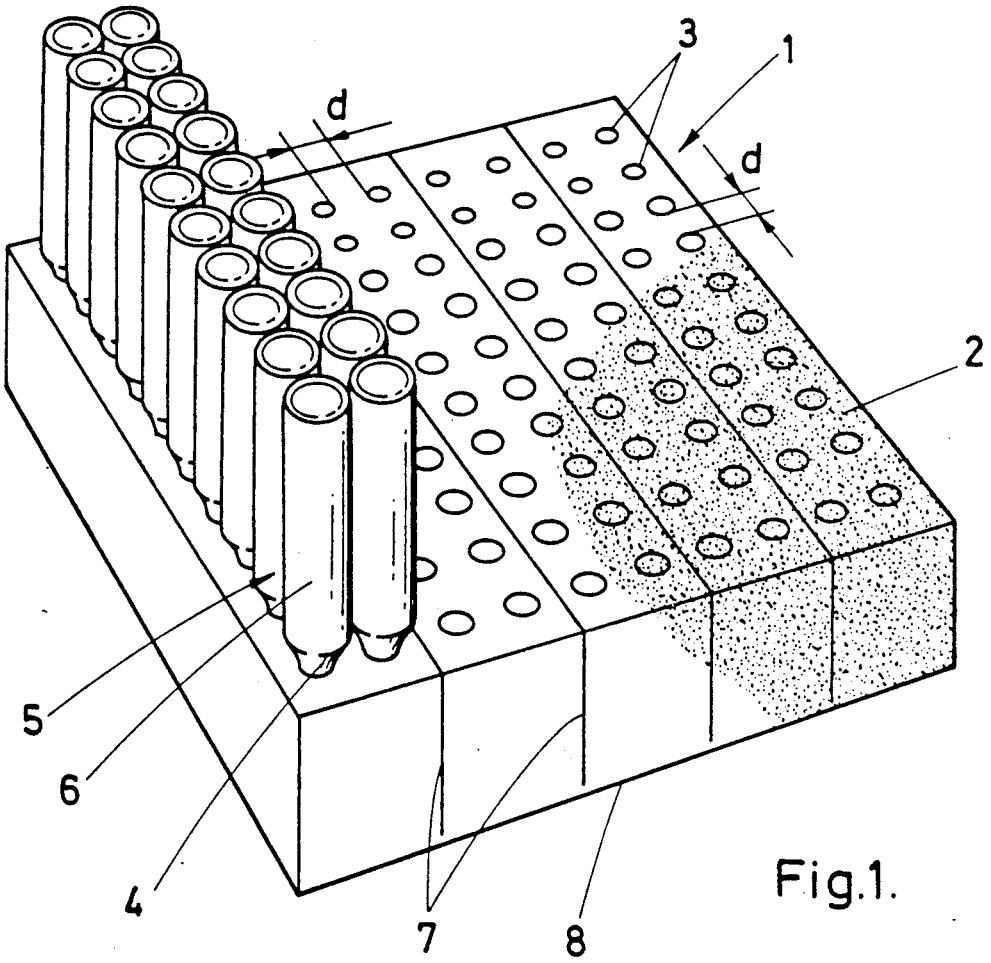
FIG. 1 is a perspective view of a particular embodiment of the package according to the invention, only two rows of articles consisting of ampules being however shown for clearness of the drawing.

In these various Figures, the same reference numerals designate identical elements.

Although the invention relates in general to a package for articles which are grouped in a varying number, according to the case, and are of any kind and shape presenting at least an extreme portion having an outside cross-section, which is lower than any analogous cross-section, essentially parallel to the first-named cross-section, of another portion of these articles, it is more particularly relating to a package for ampules, flasks, vials, syringes, bottles, the above-mentioned extreme portion of which consists of their neck, mouth or any narrowed end.

As shown by FIG. 1, this package comprises a support 1 made of a plate of a rectangular, square or prismatic shape, in at least one of the faces 2 of which a number of recesses 3 are provided, a narrowed and substantially conical end of a number of identical ampules 5 being able to be entered removably into each of said recesses 3.

The body itself 6 of these ampules, having a cylindrical shape, is located externally to the plate 1.

The distance separating two adjacent recesses is such that the bodies 6 of the ampules 5 extend side by side, preferably so as to be able to rest against each other when their conical end 4 has been inserted into the recesses 3.

Thus, in this particular embodiment of the package according to the invention, the recesses 3 are formed as cylindrical holes which preferably pass completely through the support plate 1. The distance "d" or the thickness of material between two adjacent holes is substantially equal to the external mean diameter of the narrowed end 4 of the ampules 5.

The support plate 1 is preferably made of a semi-rigid cellular material, such as polyurethane, polyethylene, polystyrene, rubber, wherein said holes 3 are carried out.

Owing to the rather elastic character of this material, the narrowed ends 4 of the ampules can be grasped in the holes 3 if the diameter of the latter is slightly lower than the maximum diameter of said narrowed end 4.

Moreover, due to the fact that the support 1 is made of a cellular material, the inside walls of the holes 3 have a more or less rough aspect, which increases the gripping and retaining power of said narrowed ends 4 in said holes 3.

If necessary, use may be made of a waterproof and moisture-resistent material and/or of a material which meets the very strict sanitary requirements existing in the pharmaceutical field.

Still according to the particular embodiment such as shown by the enclosed Figures, the holes 3 extend through the support plate 1 as rows which are parallel to the sides of the plate, while a line or area of low mechanical strength, formed by a cutting 7, extending from the face 2 of the plate 1 up to a short distance from the opposite face 8 of the latter, is provided between each two consecutive rows of holes.

In this way, it is possible, after having wholly filled a support plate with ampules, to separate easily, for example groups of 2, 4, 6 and the like rows of ampules, according to the requirements, which then can be packaged in individual boxes.

Figure 2:
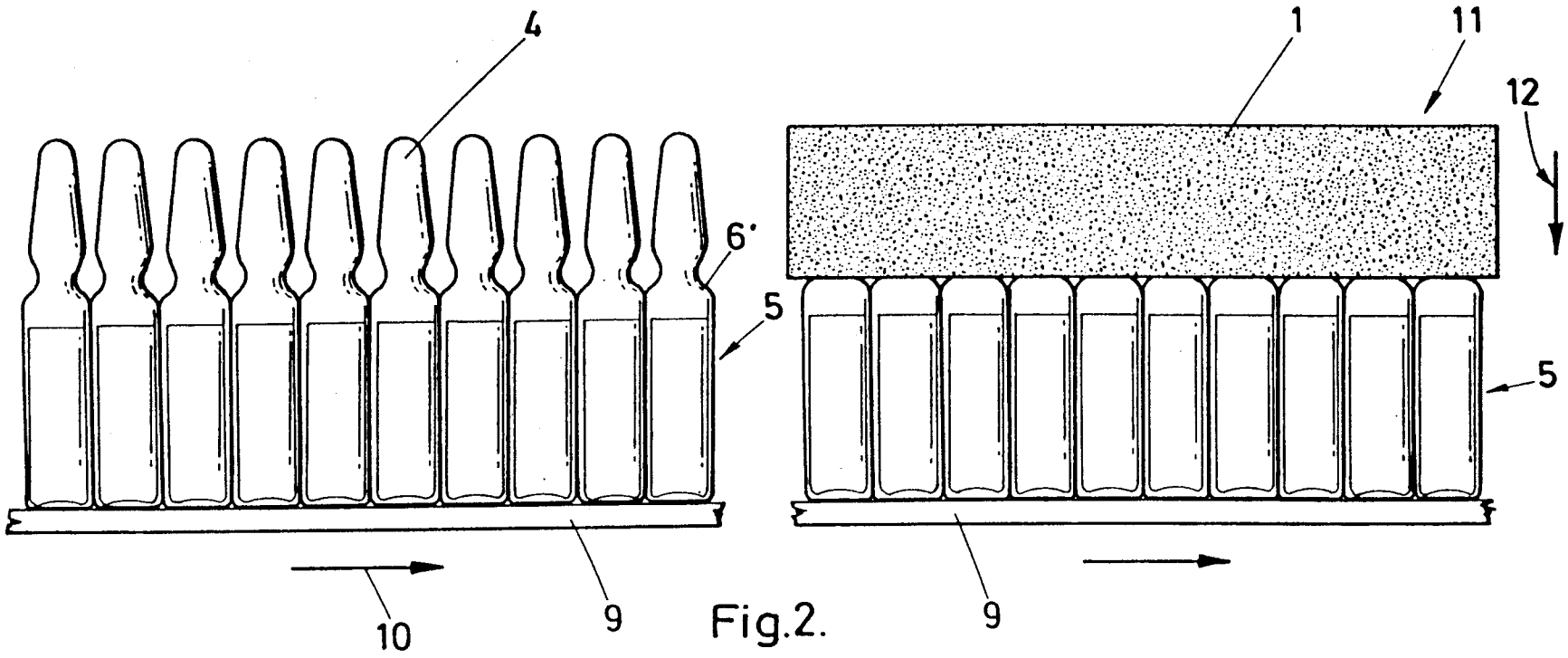
FIG. 2 is a schematical, partly broken, elevation view of a line for assembling ampules by means of a package according to the embodiment shown by FIG. 1.

FIG. 2 allows to more concretely illustrate a particular packaging process, wherein use is made of a package such as hereinabove described.

This FIG. 2 shows an assembly of filled, sterilised, washed and candled ampules 5 which move along their vertical position, against each other, with their narrowed end 4 turned upwardly, onto a conveyor belt 9, for example according to the direction of the arrow 10, to an assembling unit 11.

In the assembling unit, a support plate 1 is applied onto said assembly of ampules, such as shown in FIG. 2 by the arrow 12, so that the narrowed ends 4 of said ampules simultaneously engage into the corresponding holes 3 provided in this plate.

The support plate 1 thus forms with this assembly of ampules 5 an united and compact, relatively rigid and easily handleable assembly, which can be put in boxes, conveyed or superimposed without special conditions to be necessary.

Any pressure exerted onto the base of a part of the ampules so-assembed on a support plate will be distributed onto an uniform area extending to adjacent ampules, owing to the fact that they can rest against each other.

Any pressure exerted onto the narrowed end of the ampules will be deadened by the semi-rigid material of which the support plate 1 is made.

In other respects, due to the fact that ampules are relatively firmly maintained in the support plate, they will remain, inspite of shock or drop, perfectly grouped on their support plate by mutually supporting together.

In this regard, it has to be noted that each ampule is substantially secured against motion due to the presence of adjacent ampules and that any rocking for example is prevented.

When a series of support plates with ampules are superimposed, a determined plate may rest on the base of the ampules of the lower layer, so forming a perfectly stable and at the same time protective seating for the base of said ampules. Thus this allows very easy storing and conveying to be made with high reliability.

Moreover, the volume occupied by the support plate with the ampules is reduced at the strict minimum and is substantially lower than that of conventional packages, such as so-called "rondeaux" packages wherein the ampules are laid horizontally and separately in cradles made for example of a cardboard sheet folded as loop-holes and glued on a rigid base sheet.

Being given that generally the ampules as soon as they are filled, sterilised, washed and candled are vertically arranged as shown by FIG. 2, the present-day packaging processes according to which the ampules are arranged horizontally, as in the above-mentioned "rondeaux" packages, need either much man-power or sophisticated and expensive automatical machines, while as it results in particular from FIG. 2, packaging according to the invention allows a direct assembling of ampules in their vertical position by means of an assembling unit of an extremely simple design limited to application of the support plate in an horizontal position onto the free ends 4 of the ampules at the time when the latter are in the assembling unit.

This packaging can thus be integrated at lower cost in any production line, whatever its automaticity level may be.

The thickness of the support plate 1 preferably corresponds at least to the length of the narrowed end 4 of the ampules 5, so that this end can be completely inserted into the corresponding holes 3 and that the shoulders 6' of the body 6 of the ampules can possibly rest on the face 2 of the plate, so ensuring a maximum stability of the ampules on the latter.

Due to its aspect and conception, the package according to the invention can also be used as a display stand from which the ampules may be removed one by one as they are needed.

FIGS. 3 to 8 relate to a particular plant for assembling a group of ampules 5 with a support plate 1.

This plant comprises supplying and tidying means 13 for placing ampules 5 substantially in the same ordering as the distribution of recesses 3 in a support plate 1 with their above-mentioned extreme portion 4 turned upwardly, and assembling means 14 comprising a vertical piston 22 turned downwardly and allowing to apply a support plate 1 onto said narrowed extreme portion 4 of the so arranged ampules 5 until said portions 4 at least partly enter into the corresponding holes 3 provided in the plate 1.

The supplying and tidying means 13 comprise in order to form groups of ampules aligned along two perpendicular directions against each other:

(a) a feed channel 15 having an inlet 20 through which ampules enter as a straight line one after another, while following the direction of the arrow 15' and being guided laterally in this channel 15 until formation, between the inlet 20 and the bottom 20' of said channel, of a row of ampules 5 of a predetermined number, which in this particular embodiment is equal to 10;

(b) a pushing mechanism consisting, in the present case, of a jack 16 allowing to move the ampules being in the channel 15 along a direction which is perpendicular to the longitudinal axis of said channel, as shown by the arrow 16', by a distance which is substantially equal to the diameter of the ampules 5, so as to empty the channel 15 for allowing a new row of ampules 5 to be inserted into said channel; and (c) a tidying plate 17 comprising a number of identical distribution channels 18 which are separated from each other by a partition of an as reduced as possible thickness, this partition being formed, in the present case, of a ridge 19 and extending in a perpendicular direction to the channel 15.

The width of the channels 15 and 18 substantially corresponds to the diameter of the ampules and is preferably of 0.2 to 0.3 mm larger than said diameter.

The channels 18 are located with respect to the channel 15 in such a manner that, when the channel 15 is filled up with a predetermined amount of ampules 5, namely 10 in the present case, said ampules are each facing an inlet of channels 18 in order to be inserted thereinto through the jack 16.

The bottom 20' of the channel 15, opposite to the inlet 20 of the latter, comprises a very sensible detector or release 21 which as an ampule enters into contact with it, allows the pushing mechanism 16 to be activated and the ampules being in the channel 15 to be moved to the tidying plate 17.

The piston 22 which is thus mounted above the tidying plate 17 is vertically movable between two extreme positions: a rest position, in which the piston is located at a distance from the plate 17, which is slightly higher, for example by 2 to 3 mm, than the sum of the height of ampules 5 and of the thickness of the support plate, and a working position in which the piston 2 is subjected to a displacement to the plate 17 by a distance allowing a support plate 1 to be applied onto the narrowed portions of the ampules 5.

The ampules 5 intermittently move into the channel 15 in the direction of the arrow 15' each time by a distance corresponding to the diameter of the ampules, by means of a jack 30 moving along the axis of the channel 15 between an advanced position and a retracted position, the distance between both said positions being thus equal to the ampule diameter.

Moreover, it is necessary that said positions are at a distance from the detector 21, which is a multiple of the ampule diameter, so that the exact predetermined number of said ampules can be inserted into the channel 15 between its inlet 20 and its bottom 20'.

Figure 4:
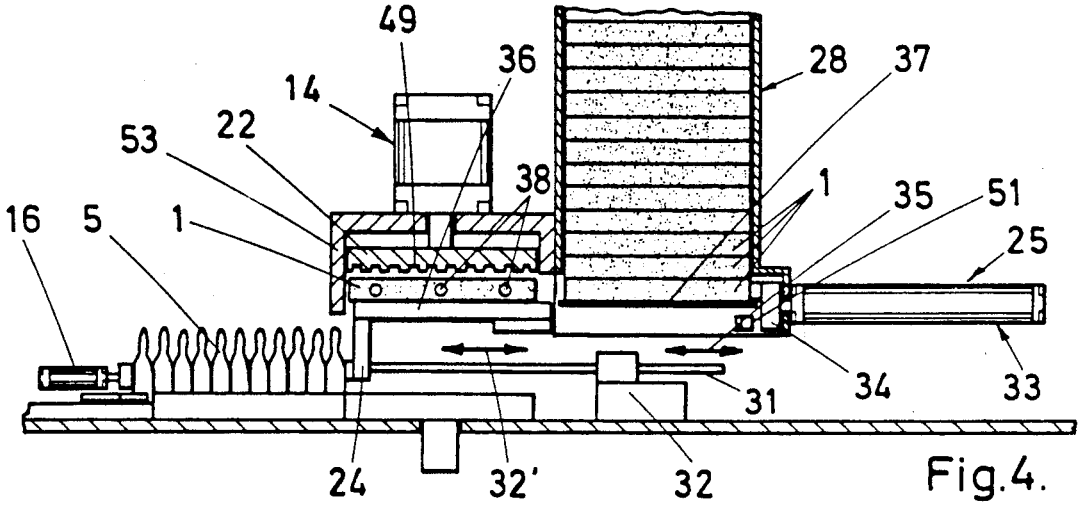
FIG. 4 is a schematical cross-sectional view, taken along line IV—IV of FIG. 3, of this particular embodiment of the plant according to the invention, in a first determined position.
Figure 5:
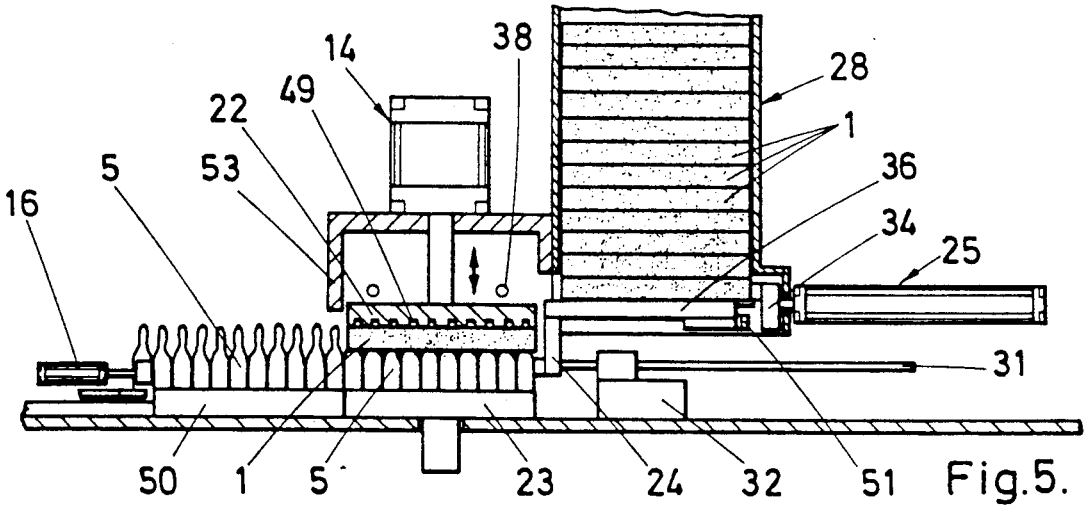
FIG. 5 is a schematical cross-sectional view, taken along line V—V of FIG. 3, of this particular embodiment of the plant according to the invention in a second determined position.
Figure 6:
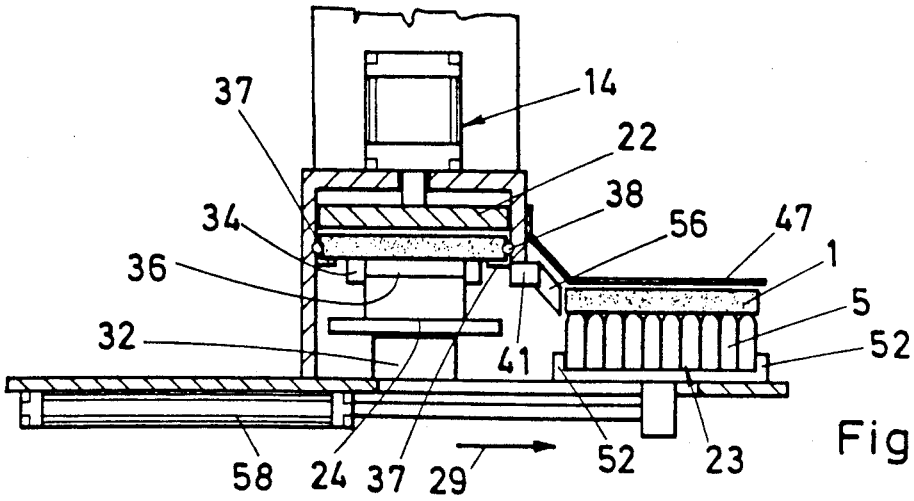
FIG. 6 is a schematical cross-sectional view, taken along line VI—VI of FIG. 3, of this particular embodiment of the plant according to the invention, in a third determined position.
Figure 7:
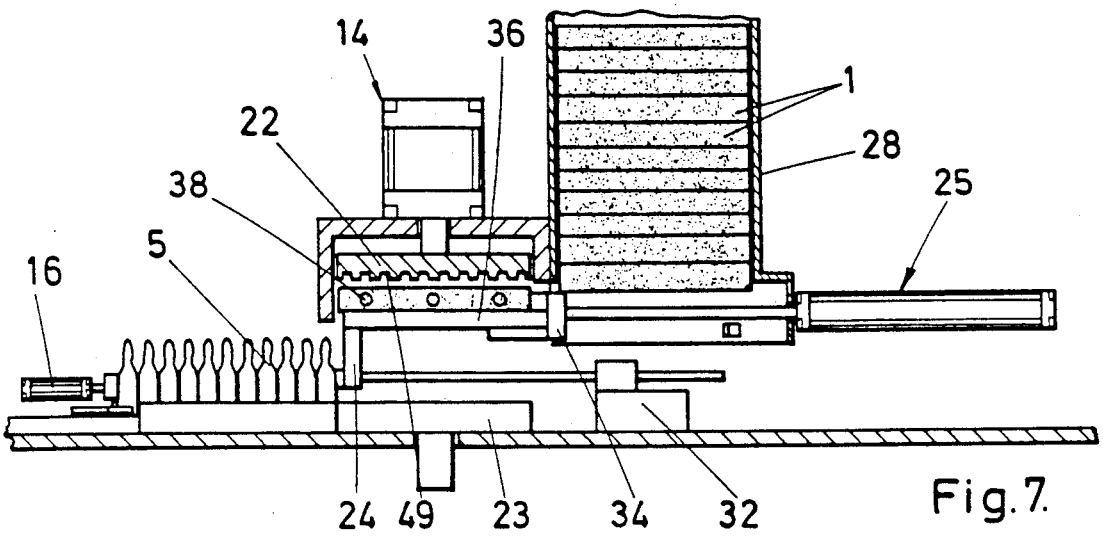
FIG. 7 is a schematical cross-sectional view, taken along line VI—VI of FIG. 3, of this particular embodiment according to the invention, in a fourth determined position.
Figure 8:
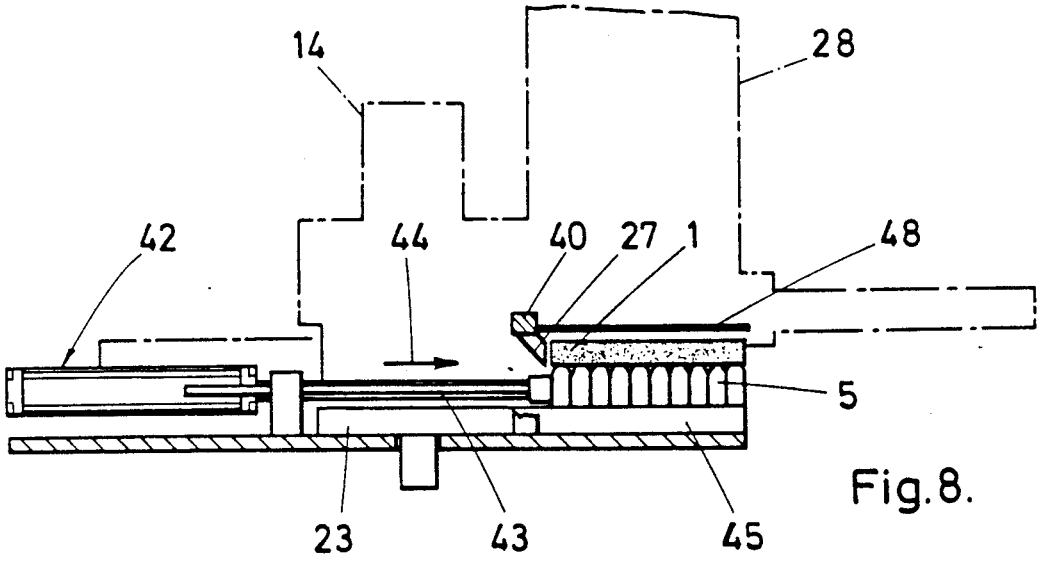
FIG. 8 is a schematical cross-sectional view, taken along line VIII—VIII of FIG. 3, of this particular embodiment of the plant according to the invention.

The tidying plate 17 comprises a sliding plate 23 cooperating with a jack 58 so as to be able to be moved along a direction which is substantially parallel to the channel 15, as shown by the arrow 29, between a loading position in which the sliding plate 23 is laterally located facing the channel 15, below the piston 22, so as to allow ampules 5 to pass from the channel 15 to the various channels 18, as shown by FIG. 3, 4, 5 and 7 and, on the other hand, an unloading position in which the sliding plate 23 is totally located beyond the channel 15, as shown by FIG. 6 and 8.

A bearing member 24 is mounted on one end of guiding rods 31 and is able to slide in the direction of the arrows 32' into a support block 32, above the sliding plate 23 along a direction which is perpendicular to the displacement direction of the sliding plate, on the whole width of the latter.

This bearing member has as a function to laterally support the ampules 5 of the front external row, viewed in the displacement direction on the sliding plate, as feeding of the ampules onto the latter proceeds in the direction of the arrow 16' under the action of the jack 16, as explained hereabove.

The plant also comprises a magazine 28 located against the assembling means 14 opposite to the feed channel 15, in which magazine support plates 1 are stored above each other.

This magazine 28 has a horizontal cross-section the sizes of which substantially correspond to the sizes of the large faces of said support plates and is mounted above a loader 25. This loader 25 allows the support plates 1 which are superimposed in this magazine to be brought one by one under the piston 22.

To this end, the loader 25 comprises a jack 33 which is arranged at the bottom of the magazine 28 opposite to the assembling means and which comprises a piston 34 horizontally movable along the direction of arrows 35 between a retracted rest position, such as shown by FIG. 4 and 5, and a protruded working position, such as shown by FIG. 7.

Moreover, it comprises a table 36 which is made integral with the bearing member 24, and against which the piston 34 of the jack 25 can push, so that this table can be moved at the same time as the bearing member 24 from the position illustrated by FIG. 5 to the position such as shown by FIG. 4 and 7, below the piston 22.

The piston 34 being completely free with respect to the table 36, when this piston comes back to its retracted position, after having pushed the table 36 to below the piston 22, this table as well as the bearing member 24 remain in the protruded position, as clearly shown by FIG. 4.

The lower support plate in the magazine 28 rests on two lateral rails 37 provided on the inside walls of the magazine, which are parallel to the displacement direction 35 of the piston 34, at the bottom of this magazine, and possibly on the table 36 when the latter is under the magazine 28, as shown by FIG. 4 and 5.

The presence of this table 36 is more particularly useful to bring a lower support plate from the magazine 28 to below the piston 22. As a matter of fact, at this time, this support plate is pushed out of the magazine by the piston 34 and can thus freely rest on said table 36.

Holding means, in the present case projecting balls 38, are provided laterally under the piston 22 at the same level as the lower support plate in the magazine 28.

These balls 38 are mounted on springs, not shown, so as to be able to slightly retract under the action of a support plate being pushed to below the piston 22, in order to be able to maintain this plate temporarily in position under the piston 22 when the table 36 is pushed back to its position below the magazine 28.

The particular embodiment of the plant such as illustrated by FIG. 3 to 8 still comprises cutting members consisting of removable and/or retractable cutters 56 mounted on a ramp 41 below the sliding plate 23 between the loading and unloading positions of the latter, such as hereinabove defined, and at a level with respect to the sliding plate, which is slightly higher than the total height of the assembled ampules with a support plate. Finally, ejection means 26 for ampules assembled by a support plate 1 are provided, these means allowing this ampule assembly to be slid away from the sliding plate 23 along the longitudinal direction of the channels 18 onto a fixed receiving plate 45 preferably comprising channels 46 which are similar to those of the sliding plate 23, as clearly shown by FIG. 3 to 8.

These ejection means 26 comprise a jack 42 the piston 43 of which is able to push against the assembled ampules 5, in the direction indicated by the arrow 44 on FIG. 8.

Cutting members 27, substantially similar to cutting members 56, also removable and/or retractable, are mounted substantially at the same level as the previous ones on a ramp 40 between the sliding plate 23 in its unloading position and the receiving plate 45.

Cutting members 27 thus allow to cut the support plate 1 fixed on an ampule assembly 5 along the direction of the arrow 44 when this assembly slides, under the action of the piston 43, i.e. along a direction which is perpendicular to the cutting obtained with the cutting members 56. To prevent the risk that the support plate 1, more particularly when it is made of a rather elastic cellular material, bends upwardly during the cutting, either due to members 56 or due to members 27, a bearing plate 47, 48 is advantageously provided beyond said members, substantially at the same level as the latter and thus above ampules assembled in a support plate 1, such as shown by FIGS. 6 and 8.

The tidying plate 17 preferably comprises, in addition to a movable sliding plate 23, a fixed part 50 located between the channel 15 and the sliding plate 23 when the latter is in its loading position, as shown by FIG. 3, 4, 5 and 7.

In order to prevent breakings in case of variations in the height of the ampules, grooves 49 are provided in the lower face of the piston 22 intended to bear on the support plate, these grooves extending at a distance "d" from each other (see FIG. 1), so that, if ampule ends protrude from the support plate under the action of the piston 22, these ends are able to enter into said grooves 49 without contacting the surface itself of the piston 22.

Advantageously, the various hereinabove mentioned jacks are of the so-called "magnetic" kind, said jacks having in particular as an advantage that a jack is only started when the movement of the jack having to operate previously has been wholly completed. In other respects with such jacks, it is possible to control the release or unlocking very precisely.

The sliding plate 23 is advantageously mounted on a linear ball-bearing in order to reduce the friction at the strict minimum.

The operation of this embodiment of the plant, as well as the particular characteristics of the process according to the invention will be described in a more detailed manner hereinafter.

The ampules 5 which leave in vertical position a candling machine, not shown by the Figures, are arranged after each other in the channel 15 until the first ampule comes into contact with the release 21 at the bottom 20' of the channel.

Figure 3:
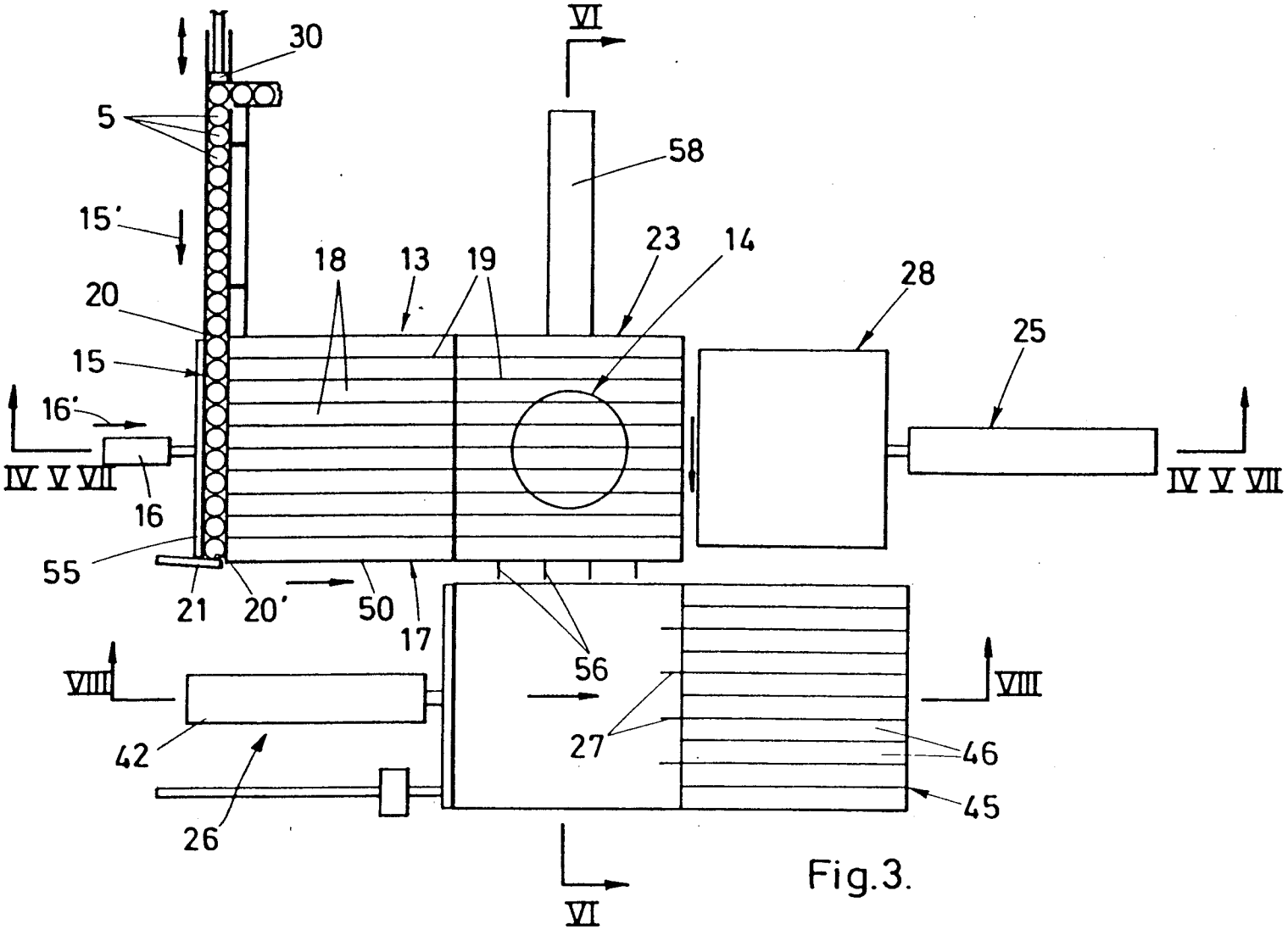
FIG. 3 is a completely schematical plane view of this particular embodiment of the plant according to the invention.

At this moment, this latter channel is filled up with a well determined number of ampules, in fact 10 in the present case as shown by FIG. 3. In a following operation, this row is displaced along the direction of the arrow 16' thanks to the jack 16, by a distance which is substantially equal to the diameter of the ampules, so that this row arrives at the fixed plate 50 by pushing the previously formed rows by a same distance, in the same direction as the arrow 16'.

Then, a new row of a same number of ampules is formed in the so liberated channel 15 and, in the same manner, again this latter row is moved onto the plate 50 by pushing all the preceding rows by a distance equal to the diameter of the ampules.

These two displacements which are perpendicular with respect to each other are alternately made until a group of ampules the number of which corresponds to the number of recesses 3 provided in the support plate 1 is obtained on the sliding plate 23 which is located in prolongation of the fixed plate 50. Thanks to the presence of channels 18, the relative arrangement of ampules 5 on the sliding plate corresponds to the relative arrangement of the recesses 3 in the support plate 1.

When the ampules move forward onto the sliding plate 23, the first row, also called front row, is supported by the bearing member 24 which moves back as rows of ampules are formed on this sliding plate by the pushing action of the jack 16.

FIG. 4 illustrates the time when the first row of ampules, which is supported by the bearing member 24, will pass from the fixed plate 50 onto the sliding plate 23.

FIG. 5 illustrates the time when the sliding plate 23 is wholly filled up with ampules, namely the time when the ampule number provided on this sliding plate corresponds to the number of recesses 3 such as provided in the support plate.

In such a situation, the bearing member 24 is in its wholly retracted position and strikes against the release 51 which brings the piston 22 to come down. The latter also applies a support plate 1 which had been previously brought under the piston 22 by the loader 25, onto the narrowed portion 4 of the ampules 5. FIG. 5 shows the piston in its down position.

Then, the piston raises again and the jack 58 displaces the sliding plate 23 which supports the ampules so assembled by means of a support plate 1 in the direction of the arrow 29, such as shown by FIG. 6, till its unloading position.

When the sliding plate is in this unloading position, a new support plate 1 is brought to below the piston 22 by the loader 25, as shown by FIG. 7, and the sliding plate can again be loaded with ampules. The piston 33 of the loader 25 then immediately comes back to its retracted rest position, as shown by FIG. 4, in order to be able to take a new plate for the following cycle.

As long as the ampules which displace in the plant are not assembled by means of a support plate 1, they are laterally supported in order to prevent that they can fall down or rock. In this respect, it has to be noted that the fixed plate 50 and the sliding plate 23 have flanges 52 which are parallel to the channels 18, as shown by FIG. 6.

According to the invention, in a preferred embodiment, it is important to provide between the channel 15 and the location where a support plate 1 is applied onto an ampule groupe, namely the sliding plate 23, a buffer area formed by a number of ampules arranged according to the same configuration as the recesses 3 provided in the support plate 1.

This buffer area allows to reduce the shock due to pushing by the jack 16, also to prevent forward rocking of the ampules onto the tidying plate 17 and also to keep the ampules in the channels 18 in a good condition against each other. Between the time when the sliding plate 23 moves from its loading position to its unloading position and comes back again in an empty condition to its loading position, and the time when the bearing member 24 is pushed by the piston 34 of the jack 33 into the position such as shown by FIG. 4, a lapse of time passes, during which new ampules enter into the plant, in particular into the channel 15.

The inlet speed of these ampules into the channel 15 is determined, in the present case, by the outlet speed of the ampules from the candling machine.

In the case when the outlet flow rate of the ampules from the candling machine is higher than the inlet flow rate into the plant according to the invention, it is possible either to use several plants in parallel, or to provide between the candling machine and the plant a buffer area in which the ampules can be waiting.

If it is supposed that the inlet speed of the ampules into the channel 15 is of about one second, it would then result that the bearing member 24 would not have had time enough to come back to its starting position in one second, so that without a buffer area for ampules, the latter would not be maintained on the side of the sliding plate 23, they would position badly and they would fall if particular relatively sophisticated cautions would not be taken. Owing to the presence of this buffer area, the sliding plate 23 and the bearing member 24 enjoy, in this particular case, 10 seconds to come back to their initial position shown by FIG. 4, namely until a complete row of 10 ampules has been formed in the channel 15.

In other respects, it is useful that the distance between the center of the holes or recesses 3, extending close to the side edges of the support plates 1 and these edges, is substantially equal to the radius of the base of the ampules for which this plate is devised.

As a matter of fact, this allows to obtain that the portions cut laterally and between two cutters are of the same dimensions.

Advantageously, it is possible to adapt a same plant for assembling ampules of different kinds and dimensions by arranging some parts of the plant in a controllable and/or removable manner.

Thus the frame 53 carrying the piston 22 could be swan-necked with the possibility of controlling the level thereof with respect to the sliding plate 23.

The tidying plate 17 could be removable in order to be possibly replaced by another plate of different dimensions and the stroke of the various jacks could be controllable.

The length of the bearing base 55 (see FIG. 3) of the jack 16 can be controllable. The width of the channel 15 could be adjustable as a function of the diameter of the ampules to be assembled.

The possibility of placing some removable strips, not shown, in some of the channels 18 could also be provided, if use is made of support plates having smaller dimensions than the surface of the sliding plate 23 or if the support plates used comprise a number of rows which is not a multiple of the row member of the plate portions obtained after cutting by means of elements 27 and/or 56. In some cases, it could be useful to provide between the fixed plate 50 and the channel 15, a blade, not shown, sliding along the longitudinal direction of this channel, so as to maintain the ampules in a well aligned condition in said channel when the sliding plate 23 is moved.

It has to be understood that the invention is not limited to the particular embodiment of the package, the process and the plant hereinabove described and shown on the enclosed drawings but that many variants can be envisaged without departing from the scope of the present invention.

Thus the support must not necessarily be a plate but could have very diversified shapes and dimensions.

The same holds true for the recesses which can also be square-shaped, or as cross- or star-shaped notches and the like, as a function of the shape and dimensions of the extreme portion of the articles intended to be inserted into these recesses.

In other respects, the articles could also be provided as a staggered arrangement, which could further reduce, in some cases, the volume occupied by a group of articles mounted on a support according to the invention.

Still in other cases, the support carrying the articles to be assembled could form a part of an enveloppe or box able to fully contain the articles.

Finally, it is obvious that other mechanisms able to cause the various movements to operate could be used instead of jacks, for example levers and the like.

What is claimed is:

1. A package for grouped articles having at least one extreme portion having an outside cross-section which is less than any analogous cross-section essentially parallel to the first-named cross-section, of another portion of these articles, in particular a package for ampules, flasks, vials, syringes, bottles, which comprises:

a support plate made of a relatively resilient, semi-rigid cellular material such as polyethylene, polyurethane, polystyrene, rubber, in at least one face of which a number of holes are provided in each of which said extreme portion of said articles can be removably maintained, each said hole having an axis extending substantially perpendicularly to the support plate and being shaped so as to enable to introduce said extreme portion substantially according to the direction of this axis into the holes, the other portion of the articles being thus located on the outside of the support, the distance between two adjacent holes being such that the other portion of the articles can extend side by side so as to bear substantially against each other and to form with the support a substantially rigid assembly when their extreme portion is at least partially inserted in said holes, said material having a sufficient rigidity, and the diameter of the holes being slightly less than the maximum diameter of said extreme portion of the articles, to be able, on the one hand, to elastically grip the above-mentioned extreme portion of the articles to be packaged in the holes and, on the other hand, to maintain these articles in position when they are arranged side by side with said extreme portion in the holes.

2. A package as claimed in claim 1, wherein the recesses extend in the support as substantially parallel rows, areas or lines of a low mechanical strength being provided between at least some of these rows so as to allow the support to be divided into distinct portions.

3. A package as claimed in claim 1, wherein the recesses are aligned in the support along two substantially perpendicular directions.

4. A package as claimed in claim 1, wherein the support has the shape of a plate or a prism in at least one face of which the recesses are provided.

5. A package according to claim 1, wherein the walls of each said hole are symmetrical with respect to said axis.

6. A package according to claim 5, wherein said holes have a substantially constant cross-section along the length thereof.

7. A package according to claim 6, wherein said holes are substantially cylindrically shaped.

8. A package according to claim 1, wherein the inside walls of the holes are rough so as to grip and retain said extreme portion of the articles.

* * * * *